US008021118B2

(12) United States Patent
Bergander et al.

(10) Patent No.: US 8,021,118 B2
(45) Date of Patent: Sep. 20, 2011

(54) TURBINE BLADE FOR A TURBINE WITH A COOLING MEDIUM PASSAGE

(75) Inventors: Katharina Bergander, Berlin (DE); Georg Bostanjoglo, Berlin (DE); Tobias Buchal, Düsseldorf (DE); Winfried Eβer, Bochum (DE); Dirk Goldschmidt, Moers (DE); Torsten Koch, Oberhausen (DE); Rudolf Küperkoch, Essen (DE); Thorsten Mattheis, Mülheim (DE); Jan Münzer, Berlin (DE); Ralf Müsgen, Essen (DE); Matthias Oechsner, Mülheim an der Ruhr (DE); Ursula Pickert, Mülheim an der Ruhr (DE); Volker Vosberg, Mülheim an der Ruhr (DE)

(73) Assignee: Siemens Aktiengesellschaft, Munich (DE)

( * ) Notice: Subject to any disclaimer, the term of this patent is extended or adjusted under 35 U.S.C. 154(b) by 1008 days.

(21) Appl. No.: 11/974,895

(22) Filed: Oct. 16, 2007

(65) Prior Publication Data

US 2008/0240927 A1 Oct. 2, 2008

(30) Foreign Application Priority Data

Oct. 16, 2006 (EP) ..... 06021677

(51) Int. Cl.
*F01D 5/14* (2006.01)

(52) U.S. Cl. ..... 416/193 A; 416/96 R

(58) Field of Classification Search ..... 415/115; 416/96 R, 97 R, 193 A

See application file for complete search history.

(56) References Cited

U.S. PATENT DOCUMENTS

| | | | | |
|---|---|---|---|---|
| 2,656,147 | A * | 10/1953 | Brownhill et al. | 416/97 R |
| 5,513,955 | A * | 5/1996 | Barcza | 416/95 |
| 6,017,189 | A * | 1/2000 | Judet et al. | 416/97 R |
| 6,457,935 | B1 * | 10/2002 | Antunes et al. | 415/115 |
| 2006/0056970 | A1 | 3/2006 | Jacala et al. | |

FOREIGN PATENT DOCUMENTS

| | | | |
|---|---|---|---|
| EP | 1 489 264 | A1 | 12/2004 |
| EP | 1 557 535 | A1 | 7/2005 |
| EP | 1 629 938 | A2 | 3/2006 |

* cited by examiner

*Primary Examiner* — Ninh H Nguyen

(57) ABSTRACT

A turbine blade for a turbine of a thermal power plant, with a platform for partial delimiting of a flow passage in the turbine, wherein the platform has at least one cooling medium passage, which extends inside the platform, for guiding a cooling medium, is characterized according to the invention in that the at least one cooling medium passage emerges from the platform at at least two connecting openings, and the turbine blade has at least one supplementary component which can be fastened on the platform, with a communicating passage, which is designed for interconnecting the connecting openings in a fluid-guiding manner.

12 Claims, 2 Drawing Sheets

TURBINE BLADE FOR A TURBINE WITH A COOLING MEDIUM PASSAGE

CROSS REFERENCE TO RELATED APPLICATIONS

This application claims priority of European Patent Office application No. 06021677.7 filed Oct. 16, 2006, which is incorporated by reference herein in its entirety.

FIELD OF INVENTION

The invention relates to a turbine blade for a turbine of a thermal power plant, with a platform for partial delimiting of a flow passage in the turbine, wherein the platform has at least one cooling medium passage, which extends inside the platform, for guiding a cooling medium. Furthermore, the invention relates to a turbine with such a turbine blade.

BACKGROUND OF THE INVENTION

During operation of such a turbine, a hot flow medium, such as hot steam in the case of a steam turbine, or hot gas in the case of a gas turbine, flows through the flow passage. In order to protect the platform, which partially delimits the flow passage, against overheating, it is therefore important to cool the platform. In the case of platforms from the prior art, for this purpose cooling medium passages in the form of film cooling holes are introduced into the surface of the platform which faces the flow passage. These film cooling holes are very thin in cross section and emerge from the surface of the platform at an acute angle. By means of the film cooling holes, a cooling film is created over the surface of the platform. Introducing the cooling air holes into the platform, however, is very costly. Also, the cooling effect which is achievable by it is limited.

SUMMARY OF INVENTION

It is an object of the invention to provide a generic-type turbine, in which the platform of the turbine blade can be cooled more effectively and/or the cooling function of the platform can be achieved with reduced cost in production.

This object is achieved according to the invention by the turbine blade which is referred to in the introduction, in which the at least one cooling medium passage emerges from the platform at least two connecting openings and which has at least one supplementary component, which can be fastened, or is fastened, on the platform, with a communicating passage which is designed for interconnecting the connecting openings in a fluid-guiding manner. Furthermore, the object is achieved according to the invention by a turbine which has such a turbine blade. The object is further achieved according to the invention by a supplementary component for a turbine blade of a turbine of a thermal power plant, which blade has a platform for partial delimiting of a flow passage in the turbine which comprises at least one cooling medium passage, which extends inside the platform, for guiding a cooling medium, and which emerges from the platform at least two connecting openings, wherein the supplementary component is designed for fastening on the platform and has a communicating passage which is designed for interconnecting the connecting openings in a fluid-guiding manner. The turbine blade according to the invention can be designed for use in a gas turbine or a steam turbine. Furthermore, the turbine blade can be formed as a stator blade or as a rotor blade. In the case of the platform which is cooled according to the invention, it can therefore be a rotor blade platform and/or a stator blade platform, especially an upper or lower stator blade platform.

By the provision according to the invention of a supplementary component with a communicating passage, the at least one cooling medium passage can be formed with enlarged cross section. By the connecting of the at least two connecting openings via the communicating passage of the supplementary component, cooling medium discharging at the connecting openings, and consequently being lost for platform cooling, is prevented. Without such a supplementary component, the cooling medium passage would have to be designed as a hole with a very small cross section in order to minimize as far as possible the cooling medium loss through the connecting openings which then function as access holes.

Since with the turbine blade according to the invention the cooling medium passage can be designed with enlarged cross section, this can be operated with a correspondingly higher throughput of cooling medium. Consequently, the cooling effect of the at least one cooling medium passage is significantly improved. As cooling medium for flow-washing of the cooling medium passage, particularly gaseous media, such as cooling air, and/or liquid cooling media, are a possibility.

Due to the possibility which is created by means of the invention of producing the cooling medium passage with enlarged cross section, the cooling medium passage can already be produced during the casting of the platform or the turbine blade, as the case may be. The cooling medium passage, therefore, must not be subsequently introduced into the platform by means of a metal-cutting process, such as by drilling. According to the invention, therefore, the cooling function of the platform can be provided with reduced cost in production. Due to the possibility of already producing the cooling medium passage during the casting process, the cooling passage can also be manufactured with optimized geometry for cooling effect. In this way, for example, it is possible to design the cooling medium passage in curved form, particularly in meander form.

By the provision of a supplementary component which is separate from the turbine blade, the complexity of the components, or component of the turbine, which are, or is, to be produced as a whole, is further reduced. This enables a cost saving in the production process. Furthermore, due to the modular construction of the turbine blade, a possible repair of the turbine blade is made easier. In this way, for example, the supplementary component can be separately exchanged if required. Furthermore, an improved output rate of the individual components in the casting process can be achieved. This output rate for example can be achieved by simplified geometries and by avoiding cross sectional changes. Such an improvement of the output rate can particularly be achieved in the case of directional solidification of the cast components, or cast component, as when using DS alloys or SX alloys.

Furthermore, it is expedient if the individual cooling medium passages emerge in each case from the platform at a first connecting opening and a second connecting opening, and if a first supplementary component and a second supplementary component are provided for the respective fluid-guiding connecting of the first connecting opening or of the second connecting opening respectively. Consequently, for example, two cooling medium passages can be connected at both ends by means of supplementary modules, as a result of which a closed guiding system is created. As a result of this, a cooling medium circuit can be established.

Furthermore, it is advantageous if the turbine blade has a longitudinal extent, with regard to which it can be installed in the turbine radially to a rotor axis of the turbine, if the platform extends along a main delimiting surface transversely to the longitudinal extent of the turbine blade and also has end faces which are arranged transversely to the main delimiting surface, and if the connecting openings, which are interconnected via the at least one supplementary component, are arranged on one of the end faces, particularly on an end face which, in the installed state, extends parallel to the rotor axis. This end face then has the connecting openings which are to be interconnected via the supplementary component. It is particularly advantageous if the supplementary component is designed in such a way that in the state attached to the platform it continues the surface of the platform which faces the flow passage. The supplementary component advantageously continues the flow surface of the platform in such a way that the transition creates no additional turbulences in the flow medium. It is further advantageous if connecting openings are arranged on two end faces of the platform which point in each case in opposite directions. In this case, two supplementary components should be provided, one for each of the two end faces. Furthermore, it is advantageous if the at least one cooling medium passage extends inside the platform parallel to the main delimiting surface. In this development, the main delimiting surface of the platform can be particularly efficiently cooled.

The turbine blade according to the invention is particularly robust during operation of the turbine if the at least one supplementary component is connected to the platform in a material-bonding and/or positive locking manner. Consequently, a loadable connection between the platform and the supplementary component is created, which leads to the connection between the components resisting the intense forces which occur during operation of the turbine. Consequently, maintenance interruptions and repair interruptions during operation of the turbine are minimized. Furthermore, it is advantageous if the supplementary component has sealing grooves and/or sealing points. In addition, it is expedient if the supplementary component is specifically adapted in its shape to compensate interspaces between platforms of two adjacent turbine blades in the installed state of the turbine blades.

In a further advantageous embodiment, the communicating passage extends completely inside the supplementary component and particularly has a U-shape. The cooling medium which flows through the communicating passage can particularly cool the surface of the supplementary component which is adjacent to the flow passage. The communicating passage in the supplementary component can advantageously be formed by forming, such as by casting or forging, or also by subsequent mechanical processing.

In a further expedient embodiment of the turbine blade, the platform and the supplementary component have different materials. Consequently, the platform is manufactured from a different material or from a different material composition from that of the supplementary component. The respective component is advantageously manufactured with a material which is adapted to mechanical or chemical requirements of the respective component. In this way, the supplementary component can be manufactured for example from "uncongenial material". For example, it is advantageous if the supplementary component has anti-oxidation material.

Furthermore, the aforementioned object is achieved by the turbine blade which is referred to in the introduction, in which the platform is a cast part and the at least one cooling medium passage comprises a cavity which is cut out during casting of the platform. The cooling medium passage, therefore, must not be subsequently introduced into the platform. On the contrary, the platform can be cast, if necessary together with other sections of the turbine blade, simultaneously forming the cooling medium passage. The production of the turbine blade, consequently, is made appreciably easier. Furthermore, it is advantageous if the supplementary component is also a cast part, and the communicating passage comprises a cavity which is cut out during casting of the supplementary component.

In an advantageous embodiment, two cooling medium passages are provided, which emerge from the platform at one of the at least two connecting openings in each case. Consequently, a cooling passage is associated with each connecting opening, and the supplementary component enables the connecting of the at least two cooling medium passages. Furthermore, in an expedient embodiment, the at least two cooling medium passages extend rectilinearly in each case, and particularly parallel to each other. Consequently, the cooling medium can be particularly directly guided to possible outlet openings on the platform surface. The at least two cooling medium passages particularly extend transversely to an axial extent of the rotor. With the provision of a plurality of cooling passages which are arranged transversely to the axial extent of the rotor, the platform cooling, as a result, can be very well adjusted to a flow medium temperature gradient which exists in the flow passage along the axial extent of the rotor. In this way, cooling passages which lie further upstream can be exposed to a cooling medium which cools correspondingly more intensely than cooling passages which lie further downstream. Consequently, the cooling behavior of the cooling passages can be adjusted to the temperature pattern of the flow medium in the flow passage, the temperature of which decreases downstream. Cooling medium passages can be designed to be cylindrical, conical or polygonal in cross section.

An especially effective platform cooling can be achieved if additional cooling cavities are provided, particularly cooling holes which lead into the surface of the platform, and if the at least one cooling medium passage is formed as a cooling medium supply passage which supplies the additional cooling cavities with cooling medium. Such cooling holes can be designed as film cooling holes, by which a cooling film can be created over the platform surface. The cooling medium passage in this case supplies a plurality of cooling cavities with the cooling medium. By the provision of a cooling medium supply passage according to this advantageous embodiment of the invention, the cooling medium, which is required for cooling the platform, can be particularly efficiently fed to the additional cooling cavities. The cooling medium supply passage can also feed cooling cavities which have no outlet on the surface of the platform. The cooling cavities can also have an outlet, for example on an abutment edge to an adjacent platform. The cooling medium then enters the flow passage through a gap between the adjacent platforms and cools the platform in the region of the abutment edge. Furthermore, it is advantageous if the additional cooling cavities, after casting of the platform, are introduced into the platform by means of a metal-cutting process, such as by drilling.

In an advantageous embodiment of the supplementary component according to the invention, this is designed as a cast part, and the at least one communicating passage comprises a cavity which is cut out during casting of the supplementary component. It is further advantageous if additional cooling cavities are provided in the supplementary component, particularly cooling holes which lead to the surface of the supplementary component, which after casting of the supplementary component are introduced into the supplementary component by means of a metal-cutting process.

BRIEF DESCRIPTION OF THE DRAWINGS

An exemplary embodiment of a turbine blade according to the invention is explained in more detail in the following with reference to the attached schematic drawing.

In the drawing.

DETAILED DESCRIPTION OF INVENTION

Figure 1:
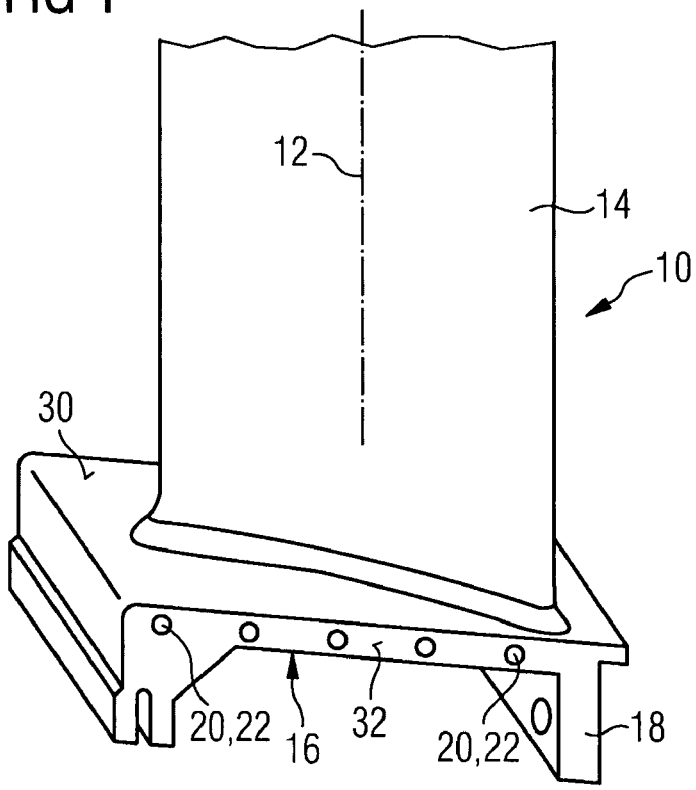
FIG. 1 shows a perspective partial view of an exemplary embodiment of the turbine blade according to the invention, with a platform without graphic representation of a supplementary component for arranging on the platform.

In FIG. 1, an exemplary embodiment of a turbine blade 10 according to the invention is shown, which basically extends along a longitudinal axis 12. In the present case, the turbine blade is designed as a stator blade. It is to be noted at this point, however, that the invention is not only limited to a stator blade, but is also to comprise for example rotor blades. The turbine blade 10 comprises a blade airfoil 14 which extends along the longitudinal axis 12 and is only partially shown in FIG. 1. A platform 16, which is oriented transversely to the longitudinal axis 12, is connected to one end of the blade airfoil 14. With a turbine blade installed in an associated turbine, the platform 16 serves for delimiting a flow passage in the turbine by means of a main delimiting surface 30 of the platform 16 together with platforms of other turbine blades. A fastening structure 18, for fastening the turbine blade on a casing or on a stator blade ring, is connected to the platform 16 at the bottom. In the case of a rotor blade, the fastening structure 18 is designed as a blade root for fastening the blade on a rotor of the turbine.

A plurality of cooling medium passages 20 extend inside the platform 16. The cooling medium passages 20 in the present case are formed rectilinearly and, with the turbine blade 10 installed in the turbine, extend transversely to the axial extent of the rotor of the turbine. The cooling medium passages emerge from the platform 16 on a first end face 32 and a second end face 34. The two end faces 32 and 34 basically extend perpendicularly to the main delimiting surface 30 and transversely to an axial extent of the rotor in the state of the turbine blade 10 installed in the turbine.

Figure 2:
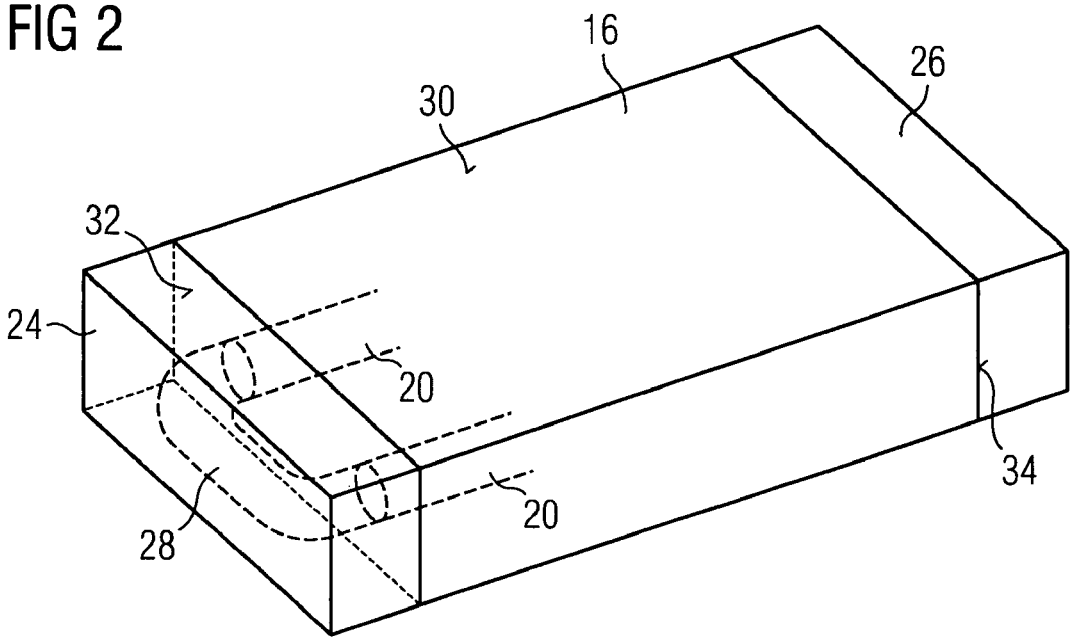
FIG. 2 shows a perspective view of the platform according to FIG. 1 in a much simplified representation from a direction of view which is rotated by about 90°, together with two supplementary components which are arranged on respective end faces of the platform.
Figure 3:
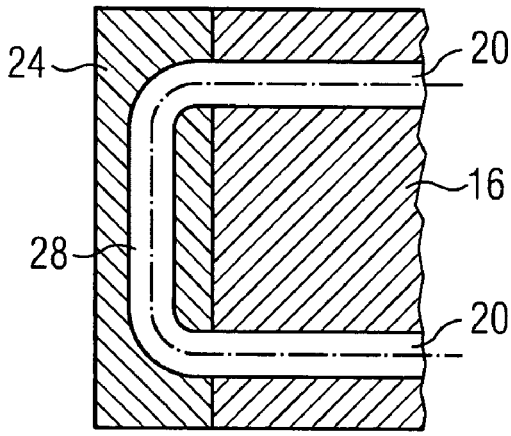
FIG. 3 shows a partial view of the platform, and also of a supplementary component according to FIG. 2, in longitudinal section.
Figure 4A:
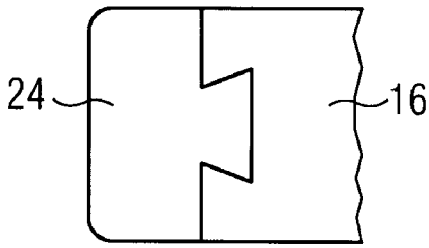
FIG. 4*a* shows a partial view of the platform with a supplementary component according to FIG. 2 in a first embodiment from the side, and also
Figure 4B:
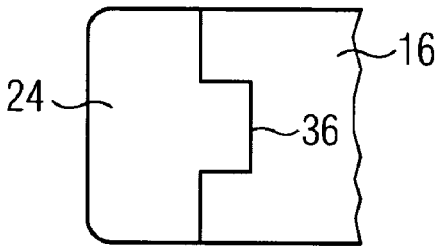
FIG. 4*b* shows a partial view of the platform with a supplementary component according to FIG. 2 in a second embodiment from the side.

As apparent from FIG. 2, a first supplementary component 24 is fastened on the first end face 32, and a second supplementary component 26 is fastened on the second end face 34. The individual supplementary components 24 and 26 have in each case a communicating passage 28 for connecting two connecting openings 22 of the associated cooling medium passages 20 in each case. For simplification, in FIGS. 2 and 3 only two cooling medium passages 20 are shown, which are connected from both sides by means of the supplementary components 24 and 26 in a fluid-guiding manner. The supplementary components 24 and 26 can be connected to the platform 16 in a positive locking manner, as shown in FIG. 4*a*. This can take place by means of a groove/tongue connection in which the groove is designed in dovetail form in cross section. Alternatively, the supplementary components 24 and 26 can also be connected to the platform 16 in a material-bonding manner, as illustrated in FIG. 4*b*. In this case, the corresponding components are preferably fastened to each other by means of a soldered or welded connection 36.

The invention claimed is:

1. A turbine blade for a turbine, comprising:

a platform for partial delimiting of a flow passage in the turbine, the platform having a cooling medium passage that extends inside the platform for guiding a cooling medium, wherein the cooling medium passage emerges from the platform at a plurality of connecting openings; and a supplementary component attached on the platform with a communicating passage that interconnects the connecting openings that guides a cooling medium.

2. The turbine blade as claimed in claim 1, wherein the individual cooling medium passages emerge in each case from the platform at a first connecting opening and a second connecting opening, and a first supplementary component and a second supplementary component that respectively connect and guide a cooling medium of the first connecting openings or of the second connecting openings.

3. The turbine blade as claimed in claim 2, wherein the turbine blade has a longitudinal extent with regard to which it can be installed in the turbine radially to a rotor axis of the turbine, the platform extends along a main delimiting surface transversely to the longitudinal extent of the turbine blade and also has end faces arranged transversely to the main delimiting surface, and the connecting openings arranged on one of the end faces are interconnected via the supplementary component.

4. The turbine blade as claimed in claim 3, wherein the supplementary component is connected to the platform in a material-bonding and/or positive locking manner.

5. The turbine blade as claimed in claim 4, wherein the communicating passage extends completely inside the supplementary component and has a U-shape.

6. The turbine blade as claimed in claim 5, wherein the platform and the supplementary component have different materials.

7. The turbine blade as claimed in claim 6, wherein the platform is a cast part and the cooling medium passage comprises a cavity which is cut out during casting of the platform.

8. The turbine blade as claimed in claim 7, wherein a plurality of cooling medium passages emerge from the platform at one of the plurality of connecting openings.

9. The turbine blade as claimed in claim 8, wherein additional cooling cavities which lead to the surface of the platform, and the cooling medium passage is formed as a cooling medium supply passage which supplies the additional cooling cavities with cooling medium.

10. The turbine blade as claimed in claim 9, wherein after casting of the platform the additional cooling cavities are introduced into the platform by a metal-cutting process.

11. A supplementary component system for a turbine blade of a turbine where the turbine blade has a platform for partial delimiting of a flow passage in the turbine that comprises a cooling medium passage that extends inside the platform for guiding a cooling medium that emerges from the platform at a plurality of connecting openings, comprising:

a first supplementary component that connects and guides a cooling medium of the first connecting openings; and a second supplementary component that respectively connects and guides a cooling medium of the of the second connecting openings, wherein the supplementary components are constructed and arranged for fastening on the platform and has a communicating passage, which fluidly guides and connects the respective connecting openings after attachment to the turbine blade.

12. A turbine for a stationary thermal power plant, comprising:

a rotably mounted turbine rotor arranged along a rotational axis of the turbine;

a stationary housing surrounding the rotor that partially delimits an outer boundary of a flow passage in the turbine; and a plurality of turbine blades arranged on the rotor having:

a platform for partial delimiting of a flow passage in the turbine, the platform having a cooling medium passage that extends inside the platform for guiding a cooling medium, wherein the cooling medium passage emerge from the platform at a first connecting opening and a second connecting opening, and a first supplementary component and a second supplementary component that respectively connect and guide a cooling medium of the first connecting opening or of the second connecting opening.

* * * * *